United States Patent [19]

Fleissner

[11] Patent Number: 4,524,589

[45] Date of Patent: Jun. 25, 1985

[54] APPARATUS FOR FROTH PROCESSING OF LENGTHS OF MATERIAL

[75] Inventor: Heinz Fleissner, Riehen, Switzerland

[73] Assignee: Vepa Aktiengesellschaft, Basel, Switzerland

[21] Appl. No.: 326,279

[22] Filed: Dec. 1, 1981

[30] Foreign Application Priority Data

Dec. 4, 1980 [DE] Fed. Rep. of Germany ..... 3045644
Jan. 17, 1981 [DE] Fed. Rep. of Germany ..... 3101337

[51] Int. Cl.[3] ..... D06B 1/06; D06B 1/14; D06B 23/00

[52] U.S. Cl. ..... 68/5 D; 26/2 R; 68/13 R; 68/202; 68/205 R; 100/121; 100/156

[58] Field of Search ..... 68/13 R, 202, 5 D, 5 E; 26/2 R; 100/121, 156, 154; 29/121.1, 121.5, 29/121.6

[56] References Cited

U.S. PATENT DOCUMENTS

| | | | |
|---|---|---|---|
| 35,896 | 7/1862 | Rust | 100/121 X |
| 943,167 | 12/1909 | Shaw | 26/2 R |
| 1,569,785 | 1/1926 | Poetzsch | 26/2 R |
| 1,640,670 | 8/1927 | Schaeffer | 29/121.5 X |
| 2,637,659 | 5/1953 | Miller | 68/13 R X |
| 2,785,042 | 3/1957 | Grajeck et al. | 68/5 D X |
| 3,090,097 | 5/1963 | Ruckstuhl | 26/2 R X |
| 3,492,840 | 2/1970 | Korsch | 68/202 |
| 3,608,477 | 9/1971 | Weber | 100/156 |
| 3,650,242 | 3/1972 | Mahoney | 68/202 X |
| 3,848,439 | 11/1974 | Lopata | 68/202 X |
| 3,913,359 | 10/1975 | Childers et al. | 68/183 |
| 3,921,377 | 11/1975 | Snyder | 68/13 R X |
| 4,156,384 | 5/1979 | Hinds, Jr. et al. | 100/121 X |
| 4,178,705 | 12/1979 | Birke et al. | 68/13 R X |
| 4,259,853 | 4/1981 | Fleissner | 68/13 R X |

FOREIGN PATENT DOCUMENTS

| | | | |
|---|---|---|---|
| 81258 | 9/1920 | Fed. Rep. of Germany | 26/2 R |
| 2223499 | 10/1974 | France | 26/2 R |

*Primary Examiner*—Philip R. Coe
*Attorney, Agent, or Firm*—Antonelli, Terry & Wands

[57] ABSTRACT

The length of material, provided uniformly over the operating width with a liquid mixed with frothing chemicals, is to be massaged on the pile side for producing the froth and/or for the complete wetting of all pile fibers. A reel or a similar device exhibiting round bars uniformly distributed over its circumference and partially encompassed by the material serves for this purpose. The length of material is in contact under tension with the rotating reel. On the rear side, the material is urged against the reel by means of an air-impermeable hugger belt, held under tension, or by means of a wear-proof pressure shell.

47 Claims, 8 Drawing Figures

APPARATUS FOR FROTH PROCESSING OF LENGTHS OF MATERIAL

The invention relates to an apparatus for the froth processing or finishing, e.g., froth dyeing, of lengths of material, especially textile material in pile shape, comprising a liquid applicator associated with the textile material and a steamer arranged thereafter.

It is known for the dyeing of lengths of material to pour the dye liquor uniformly over the operating width onto the textile material. Although it is possible thereby to attain a very satisfactory solid-color dyeing effect even in case of materials provided with a pile, a very large quantity of coloring bath is required to dye pile fibers evenly down to the root.

The use of up to 700% the quantity of dye, based on the weight of the dry material to be dyed can be reduced if a frothy or foamable dye liquor is utilized. It is known to provide dye liquor with frothing chemicals and, after mechanical frothing, apply the dye liquor to the textile material in the form of a foam layer, the foamed liquor being conducted, for example, by means of a suction effect, down to the root of the pile fibers. Even though this dyeing method requires a smaller amount of dye, the dyeing quality has not been satisfactory thus far, because this quality depends decisively on the composition of the foam and the quantity of bubbles. Nonuniformities and streaks often occur.

Improved dyeing with the aid of frothable or foamed dyeing liquor is possible if the dye is applied in the form of a thinly fluid film of dye liquor which can be more readily distributed over the pile-like material, and if then this dye liquor film is caused to froth subsequently. For this purpose, the dye liquor must be treated with frothing chemicals, poured onto the textile material in the conventional manner in the form of a thin liquid film, and conveyed in this condition into the steamer where frothing occurs spontaneously due to the supply of energy whereby the dye liquor wets the fibers over their pile length. A prerequisite for a uniform dyeing result for all fibers over the length of the pile, however, is uniform wetting and adequate foam development over the area of the textile material.

The invention is based on the problem of developing an apparatus by means of which the textile material, including the liquid film applied to the textile material, can be treated mechanically in such a way that, in spite of only minor amounts of liquid, a complete and uniform wetting of all fibers is achieved and foam is produced, at least partially, even before the material enters the heat treatment device, e.g., the steamer.

Starting with the apparatus as heretofore described, the provision is made in order to solve the posed problem that the dye applicator is followed by a stroking and/or pressing device directly associated with the application side of the textile material and revolving in a driven fashion. On account of this device, which massages or strokes the pile of the textile material, the dye-containing liquid, provided with the frothing agents and not yet in foaming condition, is treated for frothing purposes from the inside outwardly. Even with a minimal wetting rate of between about 50% and 150%, based on the dry material, a uniform wetting of the fibers with the thinly fluid dye liquor is accomplished due to the mechanical treatment which compresses (or compacts) the pile and then relieves the pressure again (i.e., the pile is released by release of the compression) at the same time, the dye liquor is caused to froth upon each pressure relief, on account of the air absorbed thereby due to suction. A contact of the length of material against the stroking and/or pressing device uniform over the working width is a prerequisite for a dyeing result without streaking.

The apparatus for massaging the pile side of the textile material after the dye application and prior to the heat treatment can be fashioned in varying ways. In any event, it is necessary to bring the stroking and/or pressing device intensively in contact with the pile, for which purpose a reel, roll or drum can be provided, for example, with a plurality of stationary round bars arranged along the circumference which bar acts to press or stroke the material, this reel being encompassed by the material to an extent of more than 60°. The reel should run in a driven fashion in such a way that a relative motion is produced between the reel and the transported material.

To intensify the treatment, two of such stroking and/or pressing devices can be arranged in series; a driven guide roller should be located between these devices for the guidance and simultaneous conveyance of the material, resulting in a meander-like looping of the material around the respective rollers by respectively about 120°. At the outlet of the massaging unit, the rear side of the length of material should be associated with a device which again raises up the pile before entering the steamer.

It is advantageous to guide the length of material during such a pretreatment in a way so that the pile side is oriented downwardly, in any event so that it is ensured that lint detached during massaging and subsequent opening of the pile or also the undesired froth collecting at the pressing device can be completely removed from this device.

It was found in experiments that the foam production depends very greatly on the extent to which the material contacts the pressing device and on the fact that air is taken in by suction on the pile side after the pressing step.

In one embodiment, the invention provides that a cover means is held over the length and in parallel to the stroking and/or pressing device, the material being guided therebetween.

This feature is based on the realization that the air contained in the voluminous textile material should be pressed out as completely as possible through the stroking and/or pressing device. During the subsequently resulting relieving ["breathing"] of the textile material, the air drawn into the textile material evokes the frothing step. A maximally complete pressing out of the air present among the fibers and/or amoung the pile fibers of the textile material is possible if the cover means, which should be held under pressure against the stroking and/or pressing device, urges the textile material against the bars, for example, of the reel. Consequently, a relatively strong longitudinal tension in the length of material, which tension would press this material against the froth developing device, becomes unnecessary.

It is advantageous to make the cover means air-impermeable. The material can be selected as desired, but is is advantageous to fashion the cover means from a steel belt or even bether a synthetic resin belt with a fabric insert, wherein the belt should cover the reel over a relatively large angle. In this connection, it is important that the contact pressure be uniform over the surface area of the material lying against the reel. For this reason, the bars on the reel must not be deformed by bending; they must be arranged exactly centrally, and also the cover means must not be dented outwardly. For this reason, it is advantageous to manufacture the reel of a cylinder on which rings are mounted at mutual spacings, the bars lying against these rings. Thus, the bars are guided over their lengths, and yet the reel can be readily cleaned and may even be self-cleaning.

It has been found that, if merely an air-impermeable belt is provided for contacting the bars, such belt will be exposed to increasing wear and tear during long-term operation of the apparatus, especially because the belt contacts the reel in a polygonal fashion, i.e., is subjected to frequent bending stresses. This disadvantage can be favorably avoided by providing instead of the belt an inherently rugged, cylindrical shell adapted to the outer radius of the reel bars, which shell contacts the reel under radial pressure. This pressure is provided in a simple way by the above-described belt which contacts the rear side of the shell under tension over an angle of about 60°.

In case of pile material, it is of course important first of all to provide the face side of the length of material with the dye liquor, or example, and then to develop this dye liquor into a froth, for which purpose the massaging devices of this invention is well suitable. However, it is also advantageous to dye the rear side of the length of material. Frequently, this rear side consists of a different type of fiber, so that additionally another dye must furthermore be applied for dyeing this rear side. This is possible in a simple way by means of the apparatus of this invention, in that the rear side of the length of material is simply associated with a padder, following the massaging device, this padder supplying the dye liquor required for the fiber of this rear side to the latter with a minimum application. A massaging device for the rear side of the length of material is unnecessary, inasmuch as no pile fibers need to be wetted at this location.

Several embodiments of the apparatus of this invention are illustrated in the accompanying drawings. Still further details of this invention, which are also significant in combination, will be described with reference to these drawings wherein.

Figure 5:
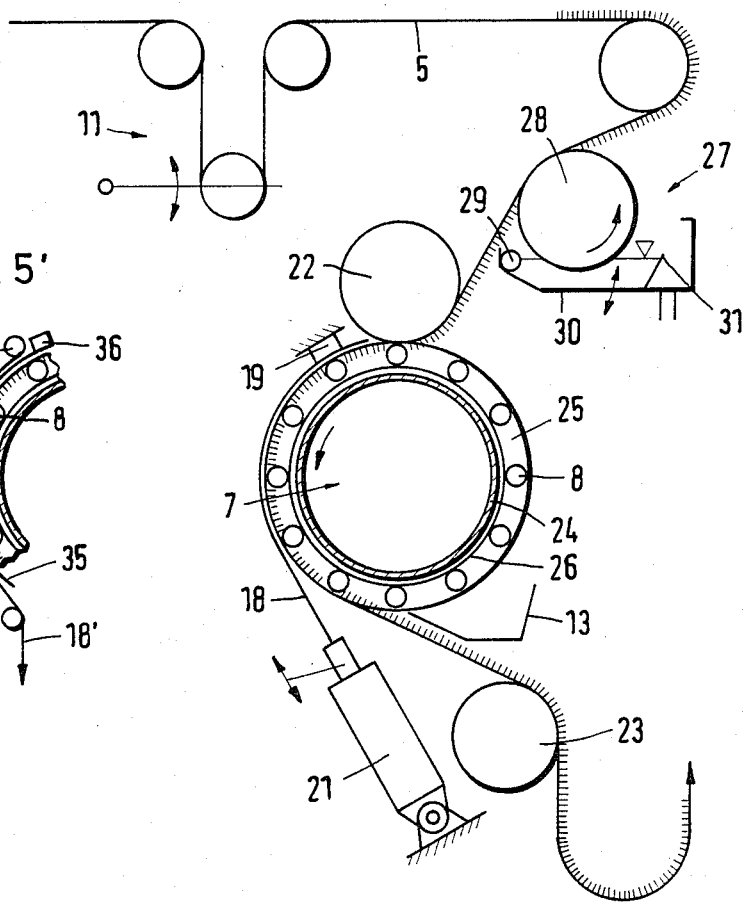
FIG. 5 shows the device of FIG. 4 with a differently constructed reel and with a liquid applicator.
Figure 5:
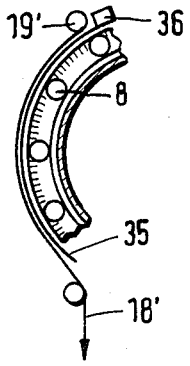
Figure 6:
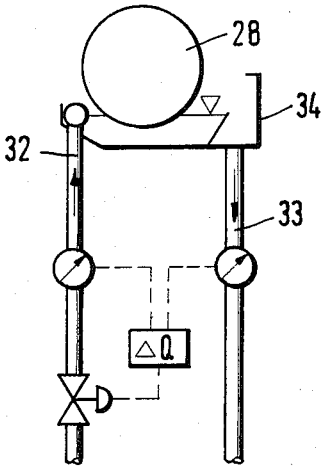

FIG. 5' shows the reel of FIG. 5 with a different version of the cover means;

FIG. 6 shows the liquid applicator of FIG. 5 on an enlarged scale; and

Figure 7:
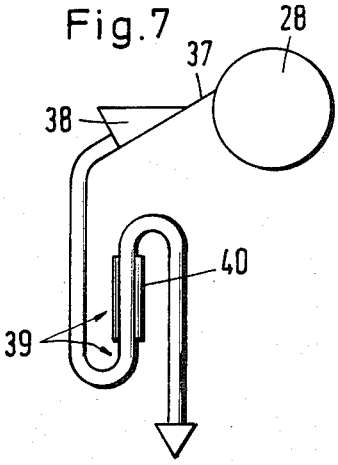

FIG. 7 shows a flowmeter on an apparatus working with an applicator roller.

Figure 1:
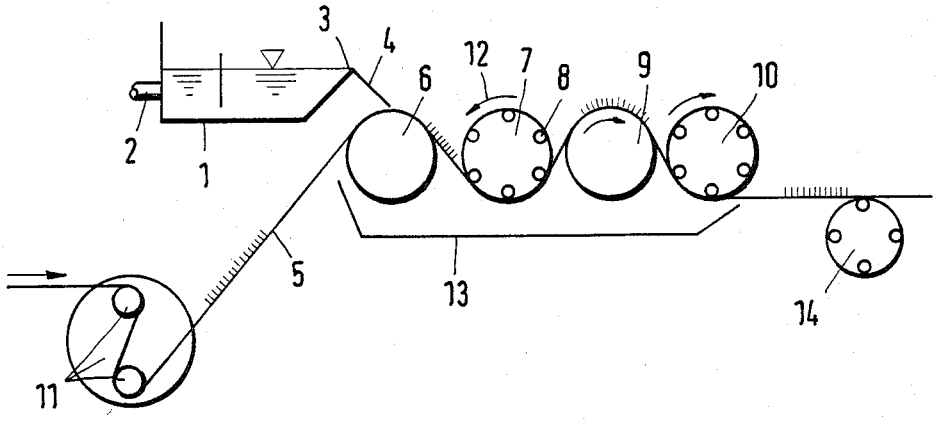
FIG. 1 is a massaging unit passed through by the material with upwardly oriented pile.
Figure 2:
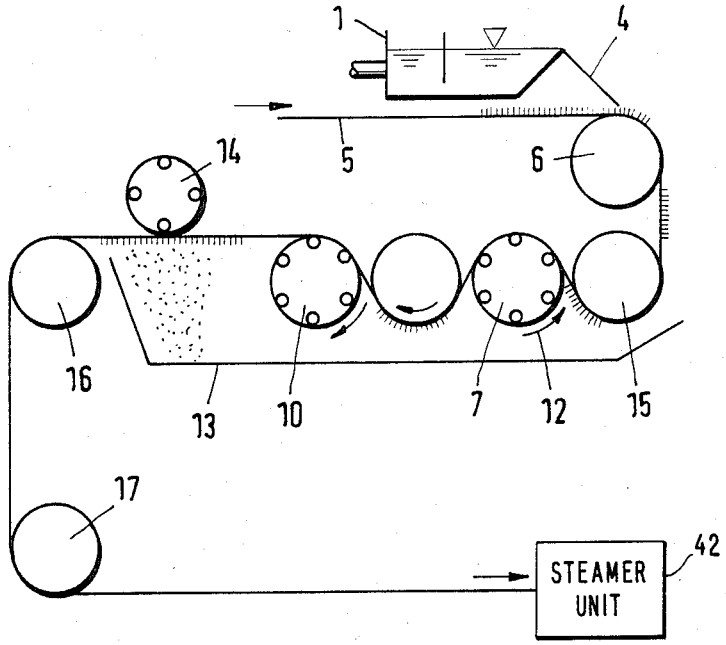
FIG. 2 is an apparatus according to FIG. 1, but in this case the material is massaged with the pile oriented downwardly.
Figure 3:
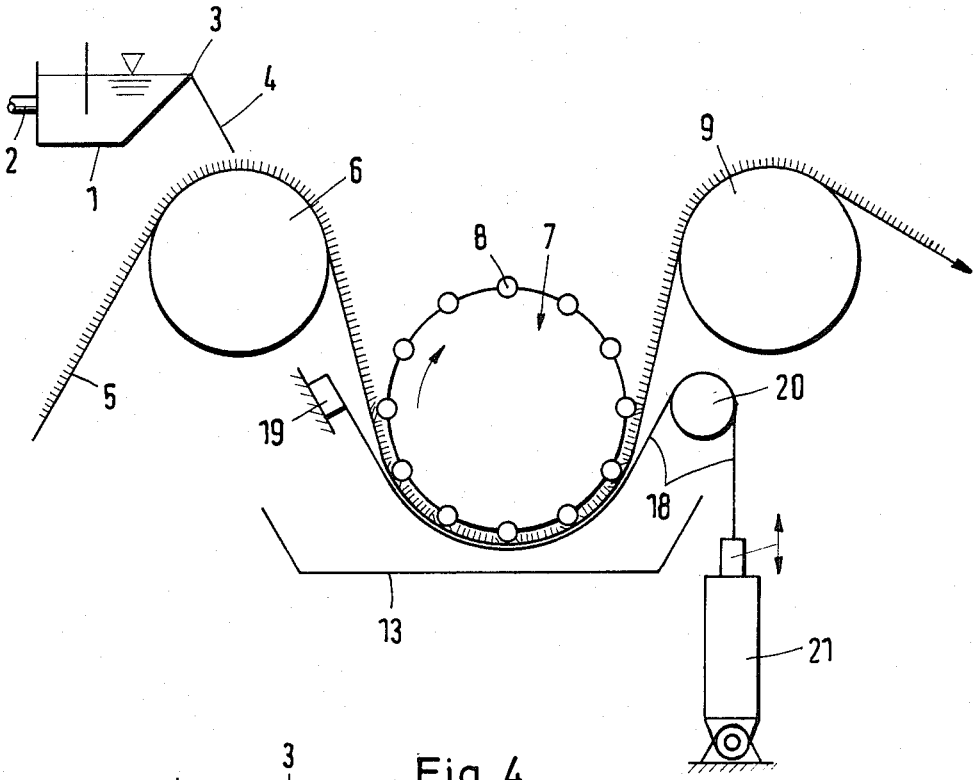
FIG. 3, is a massaging unit with only one contact reel or drum for pressing and/or stroking the material, a cover means in the form of a hugging belt being held against this reel.

Numeral 1 in FIG. 1 denotes a dye liquor applicator operating according to the pouring principle. The dye liquor, combined with frothing chemicals, is filled into the container via a pipe 2 and flows from there via an overflow edge 3 uniformly over the operating width along the doctor blade 4 onto the textile material 5 traveling directly underneath. (Different applicators are also possible at this location, and for this purpose reference may be made to FIG. 5 and the description thereof.) Following the guide roller 6 arranged underneath the drip edge of the doctor blade 4, a reel 7 is located approximately at the same level as seen in FIGS. 1 and 3. The reel is looped about by the length of material from below, whereby the pile side is pressed against the fixed round bars 8 provided on the reel. To enhance the looping around of the length of material in contact with the reel 7, a tension roller 9, rotating in a driven fashion, is then provided at a small spacing from the reel, as seen in FIGS. 1 and 2, followed by a second reel 10 to intensify the treatment, arranged likewise at the same axial level. In order to obtain the uniform longitudinal tension in the length of material, essential at this point, this massaging unit has a compensator 11 connected in front thereof, which compensator regulates the tension of the material in a conventional way.

The reel 7 is driven in the direction of arrow 12, i.e., in the conveying direction of the length of material. The reel 10, in contrast thereto, rotates in the opposite direction so that with the same rotational speed of the reel 10 a larger relative motion is produced between this reel 10 and the length of material. With a material delivery speed of up to 20 meters/minute, a rotational speed of the reels of, for example, 80 rpm is contemplated. At this low rotational speed, the pile fibers are slightly compressed and again relieved, whereby on the one hand all fibers and all fiber parts are wetted with the liquid and on the other hand the development of a froth is effected during each relief. In order to be able to catch any dripping liquid and/or superfluous foam, a collecting trough 13 is arranged underneath the rollers 6, 9 and reels 7 and 10.

A beater device 14 associated with the rear side of the length 5 of material is additionally provided upstream of the steamer 42 or other heat treatment device which follows directly thereafter. This beater acts on the rear side of the looped material or the like with a high rotational speed, namely with about 1,000 rpm to effect an uprising of the pile which may previously have remained matted down.

The apparatus according to FIG. 2 differs from that of FIG. 1 merely insofar as the pile of the material, treated in the same way with the liquid film, is oriented downwardly during massaging or compacting. For this purpose, another guide roller 15 is arranged underneath the roller 6, the length of material being first guided around this guide roller and then being subjected to the stroking or pressing devices of the same construction as shown in FIG. 1. Especially with respect to the beater device 14, it is ensured in this embodiment that the fuzz detached during beating falls downwardly and is caught by the collecting trough 13 so that it does not present obstacles during treatment in the steamer and the frothing step continued therein. The deflection of the length of material by means of the rollers 16, 17 ensures that the further conveyance of the length of material cen take place in the same direction as during feeding.

The length 5 of material is to be guided around the reel 7 with a certain longitudinal tension. However, this tension in most cases is not sufficient to urge the air contained in the pile of the textile material out of this pile to thereby develop a froth from the previously applied liquid reaching down to the pile roots. According to FIG. 3, a cover means in the form of a steel belt 18, for example, loops for this purpose around the reel 7 on the underside, which steel belt is fixedly attached to a beam 19 on the feed side of the textile material while it is suitably guided over a guide roller 20 on the outlet side and thereafter is held under controllable tension via a spring or a compressed-air cylinder 21.

It is advantageous in connection with the cover means 18 that this means not only urges the length 5 of material firmly against the reel 7, but that also the back of the length 5 of material becomes air-impermeable. This has the effect that the relief ["breathing'] taking place after each compressing exerted by the respective round bar 8 occurs only on the pile side or on the side treated with the liquid, without participation by the air present on the rear side of the length of material. This, however, is only possible if the rear side of the length 5 of material is air-impermeable which is accomplished in a simple way at the moment of massage of the length 5 of material on the front face by means of this air-impermeable cove-belt 18. To attain a satisfactory treatment effect, the contact pressure must be uniformly distributed over the working width or the material. It has been found that a synthetic resin belt with fabric insert is best suited for this purpose, since dents may be produced in certain circumstances in a steel belt, which can no longer be straightened out by vigorous stretching.

Figure 4:
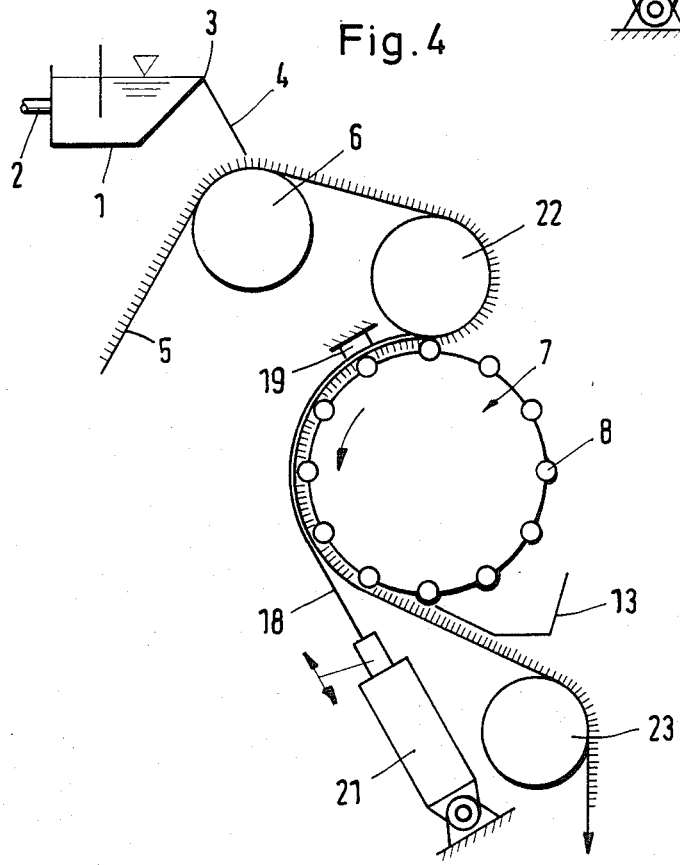
FIG. 4 shows the device according to FIG. 3 with a guidance of the material extending approximately perpendicularly.

The illustration of the apparatus in FIG. 4 corresponds essentially to that of FIG. 3, but the apparatus elements 22, 7, and 23 are arranged approximately in mutual superposition, whereby the device is not only built in a compact fashion but also offers the feature that the surplus froth produced at the reel 7 can be collected more readily by the trough 13 so that the froth does not stick improperly to the length of material. This occurrence would result in a nonuniform distribution of the foam on the length of material. Also, the apparatus, in this alignment of the apparatus elements with respect to one another, can be more readily supervised by an operator and can be more easily operated. The direction of rotation of the reel is in this case advantageously in the same direction as the conveying direction of the length 5 of material. The rotational speed of the reel is controlled to be faster than the movement of the length of material. The froth adhering to the bars 8 will drip down during the upward travel and will thus be caught by the trough 13.

The reel 7 can be built as illustrated in FIGS. 1–4, more advantageously as shown in FIG. 5, according to which it is made of a metal cylinder 24 with annular disks 25 at the end faces, the round bars 8 being mounted in these disks at a small spacing from the cylinder 24. Accurately machined spacer rings 26 are attached at intervals to the cylinder 24, the round bars 8 being supported at multiple points along their lengths on the cylinder 24 by these spacer rings. This construction has the advantage that the reel 7 is self-cleaning, although the bars have repeated contact points along their lengths and thus bending deformation of the bars is prevented even over a relatively large operating width. In case of dye change, the reel can also be readily cleaned, which would not as easily be possible in case of a direct contact of the round bars 8 on the cylinder 24 and over the entire length of the cylinder.

In the embodiments of FIGS. 3–5, the contact pressure or cover means is fashioned as an elastic belt. Although this ensures a satisfactory hugging of the bars 8 by the textile material, the belt will wear more quickly due to the frequent flexural changes and due to the friction. In this connection, the construction of the contact pressure means of FIG. 5' is of advantage, according to which a wearproof, dimensionally stable cylindrical shell 35 is mounted at point 36 and due to its concentric design is in curved contact with several bars 8. The contact pressure is provided uniformly by the belt 18' attached at point 19' and producing a radial contact pressure against the shell 35, for example by weight load and by the illustrated guide roller.

In contrast to FIGS. 1–4, FIG. 5 shows a padder 27 as the liquid applicator; this padder makes it easier to apply a smaller quantity of dye liquor to the length 5 of material in a uniform fashion than a device operating according to the pouring principle.

The padding roller 28, partially covered by the length 5 of material, dips into a basin 30, pivotably mounted about the axle 29; on the longitudinal edge opposite to the pivot 29, this trough has an overflow edge 31 over which the excessive amount of liquid introduced via conduit 32 according to FIG. 6 can flow away and can be discharged via conduit 33. In order to collect the liquid discharged via the overflow edge 31, a collecting trough 34 is mounted to the basin 30, the discharge pipe 33 terminating in this collecting trough. Flowmeters in the feed and discharge conduits 32, 33 can measure the difference of the amounts of liquid fed and discharged and thereby can effect control of the liquid necessary for the wetting step.

An improved measuring method for the amount of liquid transferred by the padding roller 28 to the textile material 5 is ensured with the device of FIG. 7. According to the embodiment, the padding roller 28 is fashioned wider by a dimension of about 20 cm than the operating width of the length 5 of material. The padding roller is extended by this dimension only on one side of the applicator. In this dimensional zone, provided outside of the operating width, a measuring doctor knife 37 of a defined width is in contact with the padding roller 28 from the bath 30 off the padding roller. The thus-stripped liquid flows into the collecting trough 38 and from there into a discharge pipe which, according to FIG. 7, is fashioned a a siphon tube 39. In this discharge pipe, the liquid stripped from the padding roller can now be measured continuously and the exact amount to be applied to the textile material can accordingly be determined. The discharge pipe is fashioned as a siphon tube because a liquid without air bubbles will always be present in the rising portion of the pipe so that here an accurate quantitative measurement is possible with the aid of an inductive flowmeter 40. Such an instrument can be attached to a production machine and even to a laboratory device so that the dyeing conditions determined during preliminary trails can be transferred to the production machine without any problems.

For wetting the rear side of the length 5 of material with an additional dye liquor, optionally one of a different composition, the guide roller 23 can serve, for example, as a padding roller; for this purpose, it is merely necessary to associate this guide roller 23, as the padding roller, with a wetting trough, not shown, the roller 23 dipping into the dye bath provided in this trough. After the length of material, thus wetted on both sides with dye liquor and having been massaged on the pile side, has entered the steamer, sufficient froth will be present on both sides of the length of material so that a dyeing throughout of all fibers is ensured.

What is claimed is:

1. An apparatus for foam dyeing of lengths of textile material having pile fibers on a pile side thereof, comprising a dye liquor applicator for applying a foamable liquid-dye liquor to the pile side of said textile material, a stroking means arranged after the dye liquor applicator along a travel path of said textile material for alternately compressing and releasing the dye-containing pile fibers to cause the dye to foam on the pile fibers, said stroking means being arranged to directly contact the pile side of the textile material and being driven to rotate and to provide a relative motion between said textile material and said stroking means and means for conveying the textile material along said travel path in contact with said stroking means so that the stroking means is partially encompassed by said textile material.

2. An apparatus according to claim 1, wherein the rotating stroking means is encompassed by the material by more than 60°.

3. An apparatus according to claim 1, wherein the stroking means comprises a reel rotatably supported and having a plurality of annularly arranged bars fixed to supporting means, said bars extending perpendicularly to the pile surface of the textile material.

4. An apparatus according to claim 3, wherein the reel consists of a cylinder with radially projecting, annular disks arranged at end faces of the cylinder, the bars being mounted to these disks at a small radial spacing from the cylinder.

5. An apparatus according to claim 4 wherein the cylinder has spacer rings over its length, the bars being in flush contact with these rings.

6. An apparatus according to claim 3, wherein the pile side of the textile material is oriented approximately perpendicularly with respect to an axis of rotation of said stroking means and to the plurality of bars arranged to successively contact the textile material while passing through the stroking means.

7. An apparatus according to claim 1, wherein two of said stroking means are arranged in series at the same axial level, and a guide roller for the meander-like guidance of the material is provided between said means, likewise at the same axial level.

8. An apparatus according to claim 7, wherein the first of the stroking means is driven to rotate in the conveying direction of the material and, the other in opposition to the conveying direction of the material.

9. An apparatus according to claim 7, wherein guide roller is fashioned as a driven tension roller.

10. An apparatus according to claim 1, wherein the dye liquor applicator is preceded by a material tension compensator.

11. An apparatus according to claim 1, wherein a collecting trough is arranged underneath the stroking means.

12. An apparatus according to claim 1, wherein following the stroking means device treating the pile side of the material, a beater and vibrator device, for example for raising the pile, is provided on the rear side of the length of material, for example, this device rotating at high speed.

13. An apparatus according to claim 12, wherein the pile side is oriented upwardly while passing through the stroking means as well as through the beater device.

14. An apparatus according to claim 13, wherein the pile side is oriented downwardly while passing through the stroking means as well as through the beater device.

15. An apparatus according to claim 1, wherein a cover means is held under tension against the stroking means over the operating periphery of the stroking means and in parallel thereto, the material to be dyed being guided between the cover means and the stroking means.

16. An apparatus according to claim 15, wherein the cover means is held under tension against the stroking means by means for applying a tensile force to said cover means.

17. An apparatus according to claim 15 or 16, wherein the cover means is an air-impermeable belt.

18. An apparatus according to claim 16, wherein the cover means comprises a steel belt which is attached at one end to a fixed support and is attached at the other end to said means for applying a tensile force.

19. An apparatus according to claim 16, wherein the cover means comprises a synthetic resin belt with fabric insert, said resin belt being attached at one end to a fixed support and attached at the other end to said means for applying a tensile force.

20. An apparatus according to claim 16, wherein said means for applying a tensile force to said cover means is a compressed-air cylinder.

21. An apparatus according to claim 15, wherein the stroking means comprises a reel and the cover means is fashioned as an inherently rugged, cylindrical shell adapted to the radius of the reel, this shell being guided under pressure at the reel.

22. An apparatus according to claim 21, wherein a belt is in contact with the rear side of the shell under tension.

23. An apparatus according to claim 15, wherein the cover means partially loops around the stroking means.

24. An apparatus according to claim 15, wherein the cover means is fashioned as a table, an endlessly rotation roller belt being guided against said table and serving as the stroking means.

25. An apparatus according to claim 1, wherein the liquid applicator is provided with a doctor blade overrun by the liquid, overflow edge of this blade terminating in a direct spacing from the pile of the material.

26. An apparatus according to claim 25, wherein outside of the actual operating width a measuring doctor blade of a specific width is in contact with the liquid applicator roller in order to strip off the liquid transported in this width by the roller; and that the measuring doctor blade is associated with a discharge pipe and the pipe is associated with a measuring device for determining the liquid flowing through the discharge pipe.

27. An apparatus according to claim 26, wherein the discharge pipe is fashioned as a siphon tube and the measuring device is associated therewith.

28. An apparatus according to claim 27, wherein the measuring device is associated with the zone of the siphon tube wherein the liquid rises.

29. An apparatus according to claim 26, wherein the measuring device is constructed as an inductive flow meter.

30. An apparatus according to claim 1, wherein the liquid applicator comprises a padder having a horizontally arranged padding roller, said roller dipping at a lower portion thereof into the dye liquor filled into a basin and being partially looped around by the material at a top portion thereof.

31. An apparatus according to claim 30, wherein the basin is pivotably supported to control the applied quantity of dye liquid.

32. An apparatus according to claim 30 or 31, wherein the basin is equipped with an overflow edge and subsequently thereto with a discharge pipe, a measuring instrument being associated with this discharge pipe to measure the effluent liquid.

33. An apparatus according to claim 1, wherein following the stroking means which effects compression to the pile side of the length of material and then produces the foam mechanically on the pile side of the material, the rear side of the length of material is associated with another means for applying compression thereto.

34. An apparatus according to claim 33, wherein the another means associated with the rear side of the length of material is fashioned as a padding device.

35. An apparatus according to claim 1, wherein said dye liquor applicator comprises a padder having a roller and a basin containing the foamable-liquid dye liquor and the paddling roller is arranged to apply the dye liquor onto the pile side of the textile material and said stroking means is arranged downstream of said dye liquor applicator to effect alternate compression and release of the pile fibers wetted with said dye liquor whereby said dye liquor is caused to mechanically foam on the pile side of the textile material and said pile fibers are completely and uniformly wetted with said dye liquor and a dye foam is produced on the pile side of the textile material.

36. An apparatus according to claim 1, wherein an arcuate cover means is arranged in the proximately of the stroking means and the textile material containing the foamable dye liquor is guided between said cover means and said stroking means whereby a complete pressing out of air present among the pile fibers of the textile material is effected due to the cover means forcing the textile material against the stroking means.

37. An apparatus according to claim 36, wherein said cover means is an air-impermeable belt arranged to extend over the width of the textile material and to partially encompass the stroking means.

38. An apparatus according to claim 37, wherein said stroking means comprises a reel rotatably supported and having a plurality of annularly arranged bars fixed to disks mounted on a cylinder and positioned around the periphery thereof for successively contacting the pile fibers of said material.

39. An apparatus according to claim 1, wherein said means for conveying the textile material comprises a pair of guide rollers, one being arranged in front of and the other being arranged behind the stroking means in the travel direction of the textile material whereby the textile material is caused to partially encompass the stroking means.

40. An apparatus according to claim 1, further comprising a heat-treatment installation for setting of the dye foam arranged downstream of said stroking means.

41. An apparatus for dyeing of lengths of textile material having pile fibers on a pile side thereof, comprising a dye liquor applicator for applying a liquid-dye liquor to the pile side of said textile material, a stroking means arranged after the dye liquor applicator along a travel path of said textile material for alternately compressing and releasing the dye-containing pile fibers to cause the dye to be uniformly distributed throughout the pile fibers, said stroking means being arranged to directly contact the pile side of the textile material and being driven to rotate and to provide a relative motion between said textile material and said stroking means and means for conveying the textile material along said travel path in contact with said stroking means so that the stroking means is partially encompassed by said textile material.

42. An apparatus according to claim 41 wherein the stroking means comprises a reel rotatably supported and having a plurality of annularly arranged bars fixed to supporting means, said bars extending perpendicularly to the pile surface of the textile material.

43. An apparatus according to claim 41, wherein the textile material is conveyed so that the pile side of the textile material is oriented approximately perpendicularly with respect to an axis of rotation of said stroking means and a plurality of bars arranged to successively contact the textile material while passing through the stroking means.

44. An apparatus according to claim 41, wherein a cover means is held under tension against the stroking means over the periphery of the stroking means and is parallel thereto, the textile material to be dyed being guided between the cover means and the stroking means.

45. An apparatus according to claim 44, wherein the cover means is held under tension against the stroking means by means for applying a tensile force to said cover means.

46. An apparatus according to claim 41, wherein said means for conveying the textile material comprises a pair of guide rollers, one being arranged in front of and the other being arranged behind the stroking means in the travel direction of the textile material whereby the textile material is caused to partially encompass the stroking means.

47. An apparatus according to claim 41, further comprising a heat-treatment installation for setting the dye arranged downstream of the stroking means by the application of steam to the dye-containing textile material.

* * * * *